United States Patent [19]

Gunne et al.

[11] 4,163,500

[45] Aug. 7, 1979

[54] BOTTLE SEAL

[75] Inventors: Ingemar Gunne, Sollentuna; Bertil Almgren, Vällingby, both of Sweden

[73] Assignee: Siemens Aktiengesellschaft, Berlin & Munich, Fed. Rep. of Germany

[21] Appl. No.: 871,536

[22] Filed: Jan. 23, 1978

[51] Int. Cl.[2] ..... B65D 51/16

[52] U.S. Cl. ..... 215/260; 215/247; 215/270; 215/307; 215/355

[58] Field of Search ..... 215/247, 260, 270, 307, 215/355

[56] References Cited

U.S. PATENT DOCUMENTS

| | | | |
|---|---|---|---|
| 2,231,418 | 2/1941 | Trotter | 215/247 |
| 2,608,972 | 9/1952 | Chrigstrom | 215/247 |
| 3,101,863 | 8/1963 | Jackson | 215/247 |
| 3,200,980 | 8/1965 | Jamell | 215/260 |
| 3,330,281 | 7/1967 | Visser | 215/247 |
| 3,456,650 | 7/1969 | Schwartzman | 215/260 |
| 3,653,528 | 4/1972 | Wimmer | 215/247 |
| 3,904,059 | 9/1975 | Bellamy | 215/247 |
| 3,976,216 | 8/1976 | Lambert | 215/260 |

FOREIGN PATENT DOCUMENTS

| | | | |
|---|---|---|---|
| 209183 | 7/1957 | Australia | 215/247 |
| 484928 | 9/1953 | Italy | 215/247 |
| 472091 | 9/1937 | United Kingdom | 215/247 |
| 766778 | 1/1957 | United Kingdom | 215/247 |

*Primary Examiner*—Ro E. Hart

*Attorney, Agent, or Firm*—Hill, Van Santen, Steadman, Chiara & Simpson

[57] ABSTRACT

A bottle seal particularly adapted for ink bottles used in automatic ink feed systems wherein the bottle seal is to be pierced by an ink withdrawal needle, the seal having a stopper which has a portion extending into the bottle neck terminating in a lip seal. The stopper portion has an outer diameter groove adjacent the lip seal with at least one air channel communicating from the groove to the exterior to allow aeration of the bottle.

3 Claims, 2 Drawing Figures

BOTTLE SEAL

BACKGROUND OF THE INVENTION

1. Field of the Invention

This invention relates to seals and more particularly to a bottle seal.

2. Prior Art

Bottle seals constituting stoppers constructed of flexible or resilient material have long been used. One well known type of seal has an upper section which forms a radially outwardly extending surface for sealingly abutting against the top end face of the bottle neck. A lower stopper section is formed as an axial extension of the upper section and is capable of being inserted into the interior of the bottle neck in a manner which seals the neck opening by contact against the interior diameter wall of the neck.

Such bottle seals have been used in the past in connection with flow systems wherein the bottle seal is to be pierced by a liquid withdrawal pin or needle. In such cases the central area of the seal is provided with at least one slit which receives and guides a liquid removal pin or needle. Also, in such constructions, it has been known to provide an overall clamp member, formed as an outer housing or cap, which squeezes the stopper against the bottle neck. The cap, generally made of metal, is also provided with a concentric opening for receipt of the liquid removal needle.

Bottle seals of the above described type have, in the past, been used in association with inking pumps of various capacities which are utilized to supply recording fluid or ink from a seal closed bottle to a recording apparatus such as an inker, printer or recorder.

In one known bottle seal for use in association with low fluid flow capacity pumps, the seal is equipped with a flexible tube to provide aeration of the bottle. The tube has one end at an upper side of the stopper which is open to the exterior. The other end of the tube projects into the bottle. A disadvantage of this type of seal is the fact that it is possible for liquid to leak out in the area of the flexible tube. Thus, whenever the seal at the juncture of the flexible tube and the stopper is incomplete, spillage can occur. Further during assembly of the flexible tube impurities can accumulate on the tube which impurities can thereafter become mixed with the recording fluid or ink. Such impurities, although minute, can clog the pump or the imprinting mechanism, particularly in those instances when the ink supply is being used with recording devices having very small passageways. Finally, manufacturing costs of such tube equipped stoppers are relativeluy high.

Another known type of bottle seal is used in connection with inking pumps having a relatively high flow capacity. In these constructions the flexible tube is eliminated and bottle aeration is accomplished through the ink removal needle. Because there are presently two types of pumps used, i.e. low and high flow capacities, with each requiring a different bottle seal, i.e. tube-no tube, there presently exists a possiblity of use of the wrong bottle seal for the pump being used. If such bottle seals are mistakenly exchanged, the result is that the pump cannot function properly. It would therefore be an advance in the art to provide a bottle seal which, while avoiding the disadvantages of the flexible tube seal, is usable in association with pumps of differing flow capacities.

SUMMARY OF THE INVENTION

It is therefore a principal object of this invention to provide a bottle seal of the above described type which does not require a flexible tube for bottle aeration and which is usable in association with pumps having various liquid conveying capacities.

According to this invention, this principal object is achieved by providing a bottle stopper having a central axial extension which projects into the bottle neck. The extension has, at its free end, an annular lip seal. A ring groove is provided adjacent the lip seal on the outer diameter of the stopper extension and an air channel communicates the ring groove with the exterior of the stopper. The air channel provides for bottle aeration. Air flows to the interior of the bottle only when required through the air channel to the ring groove and thence past the lip seal. In this manner, a single bottle seal design can be used for pumps of various capacities. Additionally the seal stopper portion can be readily sterilized and maintained in a clean state since there is no externally projecting part such as heretofore been required in connection with the flexible tubes.

It is therefore an object of this invention to provide an improved bottle stopper of the type used in connection with piercing needle bottle evacuation devices.

It is another, and more particular object of this invention to provide a bottle stopper for use in association with inking bottles, the stopper having a central slit aperture for receipt of a liquid withdrawing needle, the stopper having an extension portion terminating in an end adapted to be received interiorly of the neck of the bottle, the end having a circumferential lip seal, an annular groove in the stopper extension adjacent the lip seal and an air channel communicating the groove with a central well portion of the stopper exterior of the bottle to supply air to the bottle interior past the lip seal in response to a pressure drop interior of the bottle.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENT

Figure 1:
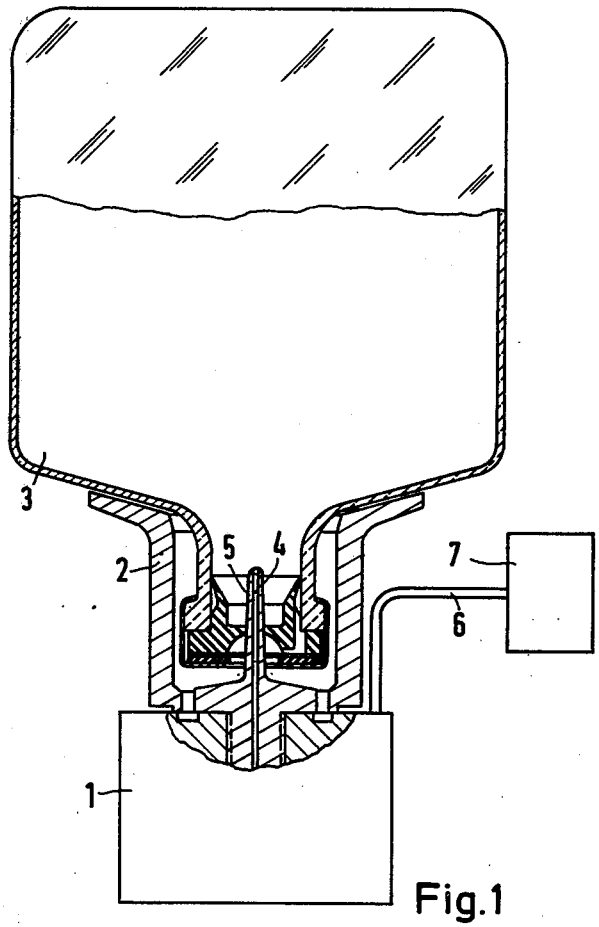
FIG. 1 is an elevational view, partially in section, of a liquid ink supplying bottle equipped with a seal according to this invention in position to supply ink to an ink utilizing device.

FIG. 1 illustrates a pump means 1 which provides a support mounting 2 for a bottle 3. The bottle is of the type used to supply ink to a recording apparatus. The support mounting 2 is rigidly affixed to the pump 1 and it, or the pump, is equipped with a liquid withdrawing needle or pin 5. The needle 5 conains a channel 4 which is used to draw ink from the bottle 3. The bottle 3 is assembled onto the support 2 by pushing the bottle into a recess in the support, the recess surrounding the needle. The needle thus contains is forced upwardly through the bottle cap into the interior of the bottle neck in communication with the contents of the bottle. Upon activation of the pump 1 the liquid is withdrawn from the bottle though the fluid channel 4 and into the pump. The pump then can be used to supply the fluid, such as ink, via a connecting conduit 6 to the ink utilizing portions of a printing apparatus or recorder 7.

Figure 2:
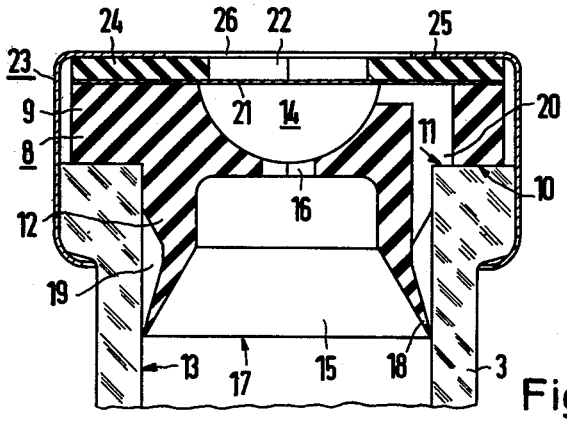
FIG. 2 is an enlarged fragmentary cross-sectional view of the neck of the bottle of FIG. 1 illustrating the seal of this invention.

The bottle seal for the bottle 3 is best illustrated in FIG. 2 which is an illustration of the sealed end of the bottle prior to insertion into the mounting 2 and piercing of the seal by the needle 5. The seal consists of a stopper 8 constructed of a flexible or resilient material. The stopper has an upper section 9 providing a radially extending contact surface 10 for engagement with the end face 11 of the bottle neck. An extension portion 12 projects from the upper section 9 and is dimensioned to be received interiorly of the bottle neck. The extension 12 contacts the inner diameter wall of the bottle neck in a manner effectuating a circumferential seal. To this end, the extension 12 may have a normal diameter slightly larger than the inner diameter to the bottle and due to the resilient nature of the material of the stopper be slightly compressible upon insertion.

Further, the stopper has outer and inner or, as viewed in FIG. 2, upper and lower concentric recesses 14 nd 15 respectively in the upper and lower sections 9 and 12. A cross or X shaped slit 16 is provided through a separating wall between the recesses.

Additionally, the extension portion or lower portion 12 terminates, in its free end, in an annular lip 18. An outer diameter groove 19 adjacent the lip end provides a circumferential zone not in contact with the inner diameter wall of the bottle neck.

An air channel 20 is provided in the stopper in order to provide for aeration of the bottle. The air channel 20 extends axially upwardly from the groove 19 along the stopper O.D. and terminates in a radially inwardly directed portion open to the recess 14.

Sealing of the bottle is additionally effectuated through the provision of a sheet 21 which overlies the top of the stopper 8 and which closes the recess 14 and air channel 20. The sheet 21 may be formed of a thin penetrate foil or plastic. On the opposite side of the sheet 21, axially aligned with the stopper 8, there is positioned a resilient or flexible disc or plate member 24. The disk 24 has an X shaped slit 22 therethrough aligned with the recess 14 and with the X shaped slit 16. A metal cap or case member 23 overlies the disk 24 and is clamped onto an enlarged head portion of the bottle neck. The cap 23 is provided with a central opening 26 in its 12 wall 25 which overlies the disk 24. The axially extending circumferential wall of the cap is inturned at its bottom into clamping abutment with the enlarged head end of the bottle neck in a manner well known to those skilled in the bottle capping art.

When the bottle 3 is to be inserted into the spport 2, the opening 26 is first aligned above or in front of the needle 5. An axial pressure is then applied to the bottle 3 such that the needle will penertrate the slit 22, the sheet 21 and the slit 16. The slits 22 and 16 are preferably constructed such that the needle will pass relatively freely through the slit 22 but will sealingly engage the periphery of the slit area 16 so as to seal off the recess 14 from the recess 15. The slit 22 is sufficiently larger than the slit 16 as to allow air to enter the recess 14 around the outer diameter of the needle 5. To this end the slit area 22 and the opening 26 are both sufficiently larger than the diameter of the needle.

When the pump 1 is activated to withdraw fluid from the bottle 3, the resultant pressure drop in the bottle 3 will cause air to be drawn past the needle 5 into the recess 14 and thence through the air channel 18 to the groove 19. Because of the pressure differential, the lip 18 will open to allow air to pass the lip into the interior of the bottle. As soon as the pressure differential is reduced below the resilient return pressure of the lip 18, the lip will contact the wall of the bottle neck and provide an effective seal once again.

It can therefore be seen from the above that this invention provides a universal bottle seal which is capable of being used irrespective of the flow capacity of the pump. The bottle is fully sealed prior to piercing by the needle due to the entrapment of the sheet 21 between the cap or compressible disk 24 and the compressible or resilient stopper portion 9 which overlies the end face of the bottle. Thus the metal cap 23 can lock the foil sheet 21 in place. However, the construction of the stopper is such that upon piercing the foil, the air channel 20 will be open to the exterior while a seal is still provided between the needle outer diameter and the periphery of the slit area 16. Further the air channel 20 is sealed due to the lip seal 18. When a pressure differential exists between the exterior environment and the bottle interior, the bottle will be aerated through the channel 20 channel as soon as the pressure differential exceeds the resilient force of the lip seal 18. When this occurs, air will bubble past the lip seal to the interior of the bottle. During this air flow or bubbling, liquid will not pass the open lip seal because of the air flow and because of the pressure differential. As soon as the pressure differential is reduced, the lip will once again seal.

Although the teachings of our invention have herein been discussed with reference to specific theories and embodiments, it is to be understood that these are by way of illustration only and that others may wish to utilize our invention in different designs or applications.

We claim as our invention:

1. In a bottle seal for a necked bottle including a resilient stopper having an extending portion adapted to be inserted into the neck of a bottle in circumferential sealing engagement with the inner diameter wall of the bottle neck, the stopper being provided with a concentric slit area for sealing receipt of a liquid withdrawing needle, the improvement of the terminating in a lip seal engageable with the inner diameter wall of the bottle neck, a circumferential groove adjacent the lip in an outer diameter of the extension and an air channel communicating the groove with a portion of the stopper on an exterior side of the slit area remote from the lip seal.

2. A bottle seal according to claim 1 wherein the stopper has an upper section provided with a concentric recess above the slit area, the recess having a diameter greater than the diameter of a needle to be inserted through the slit area, and the air channel open to the recess.

3. A bottle seal comprising a stopper having an upper portion with a concentric recess therein open to an upper face, a radial ledge intermediate ends of the stopper for sealing contact with an axial end face of a bottle neck, an axial projection extending from said ledge for insertion into the neck of a bottle, said axial extension terminating in a radial lip seal, a circumferential groove in the outer diameter of said extension intermediate the lip seal and the ledge, an increased diameter portion of the extension intermediate the groove and the ledge for sealingly engaging the inner diameter of the bottle neck, a second concentric recess extending axially of said extension open to an underside of the stopper extension defining said lip seal, said second recess having a bottom wall, a slit area in said bottom wall communicating to the recess in the upper face, said slit area having a dimension sized with respect to a fluid withdrawal needle to be inserted through said slit area such that the periphery of the slit area will sealingly engage the outer circumferential surface of the needle, said recess in said upper face having a diameter larger than said needle, an air channel communicating said groove with said upper face recess.

* * * * *